US009587864B2

(12) United States Patent
Liu

(10) Patent No.: US 9,587,864 B2
(45) Date of Patent: Mar. 7, 2017

(54) THERMAL EXPANSION VALVE

(75) Inventor: Changqing Liu, Zhejiang (CN)

(73) Assignee: Zhejiang Sanhua Co., Ltd., Zhejiang (CN)

( * ) Notice: Subject to any disclaimer, the term of this patent is extended or adjusted under 35 U.S.C. 154(b) by 613 days.

(21) Appl. No.: 14/113,574

(22) PCT Filed: Apr. 27, 2012

(86) PCT No.: PCT/CN2012/074790
§ 371 (c)(1),
(2), (4) Date: Oct. 23, 2013

(87) PCT Pub. No.: WO2012/146193
PCT Pub. Date: Nov. 1, 2012

(65) Prior Publication Data

US 2014/0041405 A1 Feb. 13, 2014

(30) Foreign Application Priority Data

Apr. 27, 2011 (CN) ..... 2011 1 0106904

(51) Int. Cl.
*F25B 49/00* (2006.01)
*G05D 23/30* (2006.01)
(Continued)

(52) U.S. Cl.
CPC ..... *F25B 41/062* (2013.01); *F25B 2341/06* (2013.01); *F25B 2341/064* (2013.01); *F25B 2600/21* (2013.01)

(58) Field of Classification Search
CPC ..... F25B 2341/06; F25B 2341/064; F25B 2600/21; F25B 41/062; H02J 7/0016
(Continued)

(56) References Cited

U.S. PATENT DOCUMENTS 5,297,728 A * 3/1994 Yano ..... F25B 41/062 236/92 B
5,642,858 A * 7/1997 Kakehashi ..... F25B 41/062 236/92 B
(Continued)

FOREIGN PATENT DOCUMENTS

CN 1932344 A 3/2007
CN 101761708 A 6/2010
(Continued)

OTHER PUBLICATIONS

International Search Report dated Jul. 19, 2012 from corresponding International Application No. PCT/CN2012/074790.

*Primary Examiner* — Henry Crenshaw
(74) *Attorney, Agent, or Firm* — Wolf, Greenfield & Sacks, P.C.

(57) ABSTRACT

A thermal expansion valve comprises a valve body and a valve core member. The valve body is provided with a first connecting chamber, a lower cavity with a transmission member built in, and a first sealing member for separating the first connecting chamber and the lower cavity. A fifth pressure-bearing surface and a sixth pressure-bearing surface, pressed by a cold medium in the first connecting chamber in opposite directions, are disposed on a side wall of the valve core member. The first sealing member comprises a first flexible sealing element, disposed between the transmission member and an upper end portion of the valve core member and having a first edge portion connected to the valve body in a sealing manner. A sum of an effective stress area of a first pressure-bearing surface of the first flexible sealing element and a stress area of the fifth pressure-bearing surface is substantially equal to a sum of an effective stress area of a third pressure-bearing surface of the upper end portion of the valve core member and a stress area of the sixth pressure-bearing surface. Through the design of the
(Continued)

structure of the thermal expansion valve, in an aspect, reliability of sealing between the valve body and the upper end portion of the valve core member can be ensured, sensitivity of the valve is improved, and difficulty of manufacturing the valve body and the valve core member can be reduced; and in another aspect, pressure influence caused by the cold medium in the first connecting chamber on the movement of the valve core member can be eliminated.

17 Claims, 7 Drawing Sheets

(51) Int. Cl.
*F25B 41/04* (2006.01)
*F16K 17/00* (2006.01)
*F25B 41/06* (2006.01)

(58) Field of Classification Search
USPC ..... 137/467.5; 236/92 B; 62/126, 202, 225
See application file for complete search history.

(56) References Cited

U.S. PATENT DOCUMENTS 5,819,548 A * 10/1998 Clawson ..... F25B 41/062 236/102
5,943,871 A * 8/1999 Ito ..... F25B 41/062 236/92 B
6,012,301 A * 1/2000 Fujimoto ..... F25B 41/062 236/92 B
6,325,296 B1 * 12/2001 Dayton ..... F16K 47/02 236/92 B
6,354,509 B1 * 3/2002 Fukuda ..... F25B 41/062 236/92 B
6,375,085 B1 * 4/2002 Martin ..... F25B 41/062 236/92 B
7,624,929 B2 12/2009 Sohn et al.
2001/0009099 A1 * 7/2001 Kobayashi ..... F16K 31/002 62/204
2002/0023460 A1 * 2/2002 Minowa ..... F25B 41/062 62/527
2002/0023461 A1 * 2/2002 Minowa ..... F25B 41/062 62/527
2002/0023966 A1 * 2/2002 Minowa ..... F16K 31/002 236/92 B

FOREIGN PATENT DOCUMENTS

CN 201666700 * 12/2010
CN 201666700 U 12/2010
JP 2009264685 A 11/2009

* cited by examiner

THERMAL EXPANSION VALVE

The present application is the national phase of International Application No. PCT/CN2012/074790, filed on Apr. 27, 2012, which claims the benefit to the priority of Chinese Patent Application No. 201110106904.9, titled "THERMAL EXPANSION VALVE", filed with the Chinese State Intellectual Property Office on Apr. 27, 2011, which applications are hereby incorporated by reference to the maximum extent allowable by law.

FIELD OF THE INVENTION

The present application relates to the technical field of refrigerant fluid control components, and particularly to a thermal expansion valve.

BACKGROUND OF THE INVENTION

A thermal expansion valve is an important component of a refrigerating system, and is one of four essential components of the refrigerating system, and the other three essential components include an evaporator, a compressor and a condenser. A main function of the thermal expansion valve is to control the valve opening by sensing a degree of superheat at an outlet end of the evaporator or an inlet end of the compressor in the refrigerating system, thereby adjusting a flow rate of the refrigerant and realizing the throttling and depressurizing of the system.

Referring to FIG. 1, FIG. 1 is a schematic view showing the structure of a typical thermal expansion valve in the prior art.

The thermal expansion valve includes a valve body 1', and an upper end of the valve body 1' is connected with an air box including an air box seat 2'4 and an air box cap 2'5. An inner chamber of the air box is separated into an upper chamber 2'2 and a lower chamber 2'3 by a diaphragm 2'1. As shown in FIG. 1, the upper chamber 2'2 is filled with a refrigerant and is connected to a thermo bulb 4'2 via capillary tubes 4'1. The thermo bulb 4'2 is used for sensing the degree of superheat of the refrigerant at the outlet end of the evaporator or the inlet end of the compressor to create a temperature pressure $P_b$ in the upper chamber. The lower chamber 2'3 communicates with the outlet end of the evaporator via a balance pipe (not shown), and an evaporation pressure $P_o$ is created in the lower chamber 2'3.

Furthermore, as shown in FIG. 1, the inner chamber of the valve body 1' is formed with a valve port 1'1 cooperated with a valve core 3'1. An upper end of the valve core 3'1 is connected with a transmission rod 3'2 which is connected to a transmission piece 3'3 located in the lower chamber. It is to be noted that, in the prior art, the valve core 3'1, the transmission rod 3'2, and a guide ball 3'4 described below are collectively referred to a valve core component, therefore the valve core component in the present prior art is formed by separated components. A guide ring 7' is sleeved outside the valve core 3'1', a chamber below the guide ring 7' is a balance chamber 1'4, and a spring 6' for supporting the valve core 3'1 is arranged in the balance chamber 1'4 and exerts an upward elastic force $P_t$ on the valve core 3'1.

Taking the valve core 3'1 and the transmission rod 3'2 as objects for pressure analysis, the valve core 3'1 and the transmission rod 3'2 are both subjected to the upward elastic pressure $P_t$ and a downward pushing force from the transmission piece 3'3. The pushing force is produced by the diaphragm 2'1 pushing the transmission piece 3'3, thus the pushing force is a force causing the diaphragm 2'1 to move downward, i.e., $P_b-P_o$. When the valve core 3'1 is in a balanced state, $P_b-P_o=P_t$, i.e., $P_b=P_o+P_t$, if a temperature at the outlet end of the evaporator is too high, $P_b$ is increased, which pushes the valve core 3'1 downwards, thereby increasing the flow of the refrigerant; and if the temperature at the outlet end of the evaporator is too low, $P_b$ is decreased, which pushes the valve core 3'1 upward, thereby decreasing the flow of the refrigerant.

However, as shown in FIG. 1, during practical working, in addition to the above temperature pressure $P_b$, the evaporation pressure $P_o$ and the elastic pressure $P_t$ from a spring, the valve core 3'1 may also be subjected to a pressure generated by the refrigerant in the first connecting chamber 1'2 to open the valve core 3'1 and a pressure generated by the refrigerant in the second connecting chamber 1'3 to close the valve core 3'1. A difference value between the two pressures generates a systematic pressure difference. For a valve with small capacity, or a low pressure refrigerating system, the affect on the valve core 3'1 caused by the systematic pressure difference may be ignored. However, for a valve with large capacity or a high pressure refrigerating system, the affect on the valve core 3'1 caused by the systematic pressure difference is significant, which may severely affect the adjusting accuracy of the valve core 3'1.

In view of this, as shown in FIG. 1, the valve core 3'1 is provided with a through hole 3'11 to communicate the first connecting chamber 1'2 with the balance chamber 1'4. A lower end of the through hole 3'11 is cooperated with a guide ball 3'4, and a gap is formed between the guide ball 3'4 and the through hole 3'11, such that pressures in the two chambers are equal, and a bearing area of a first pressure-bearing surface S'1 in the first connecting chamber 1'2 is equal to a bearing area of a second pressure-bearing surface S'2 in the balance chamber 1'4. Since the first pressure-bearing surface S'1 and the second pressure-bearing surface S'2 are subjected to pressures in opposite directions, pressures on the valve core 3'1 from the refrigerant in the first connecting chamber 1'2 are offset by each other. As shown in FIG. 2, a third pressure-bearing surface S'3 and a fourth pressure-bearing surface S'4 subjected to pressures in opposite directions are arranged in the second connecting chamber 1'3. Since the two pressure-bearing surfaces have the same bearing surface, pressures on the valve core 3'1 from the refrigerant in the second connecting chamber 1'3 are offset by each other. Therefore, whether the refrigerant flows from the first connecting chamber 1'2 to the second connecting chamber 1'3 or flows from the second connecting chamber 1'3 to the first connecting chamber 1'2, the systematic pressure difference is substantially equal to zero, thereby realizing a bidirectional balanced flow of the thermal expansion valve.

However, in the above prior art, as shown in FIG. 1, a first sealing member 8'1 is arranged between an upper end portion of the transmission rod 3'2 and the valve body 1' to separate the first connecting chamber 1'2 from the lower chamber 2'3. A second sealing member 8'2 is arranged between the valve core 3'1 and the guide ring 7' to separate the second connecting chamber 1'3 from the balance chamber 1'4. Since both the transmission rod 3'2 and the valve core 3'1 move along the axial direction, the above two seals are transmission seal and have the following disadvantages.

Firstly, the sealing performance of the transmission seal is not reliable. The leakage will be increased with the extension of the working life and the aging of rubber, which may increase the degree of superheat of the thermal expansion valve, and affect the reliability and accuracy of the thermal expansion valve.

Secondly, the transmission seal has a large frictional resistance, and the frictional resistance may be further increased with the extension of the working life and the aging of rubber, which may affect the sensitivity of the thermal expansion valve.

Thirdly, a high precision requirement is required for the cooperation between the valve body 1' and the transmission rod 3'2 and the cooperation between the valve core 3'1 and the guide ring 7', thus the valve body 3'1, the transmission rod 3'2, the valve core 3'1 and the guide ring 7' are difficult to process. If the sealing between the valve body 1' and the transmission rod 3'2 and the sealing between the valve core 3'1 and the guide ring 7' are realized by a high precision cooperation seal instead of using sealing members, the valve body 1, the transmission rod 3'2, the valve core 3'1 and the guide ring 7' will become more difficult to process.

Furthermore, the thermal expansion valve in the above prior art further has the following disadvantages.

Firstly, since the second pressure-bearing surface S'2 is arranged on a lower end surface, located in the balance chamber 1'4, of the valve core 3'1, the through hole 3'11 is required to be arranged on the valve core 3'1 to communicate the first connecting chamber 1'2 with the balance chamber 1'4 so as to realize equal pressures in the two chambers. On this basis, the guide ball 3'4 is required to be arranged at a lower end of the through hole of the valve core. To facilitate arranging the through hole 3'11 on the valve core 3'1, the transmission rod 3'2 and the valve body 3'1 are separated, and as a result, in the prior art, the valve core component has many parts including the transmission rod 3'2, the valve core 3'1 and the guide ball 3'4, which may cause a larger cumulative dimensional tolerance in an axial direction, a lowered adjusting precision of the valve and a troublesome assembly.

Secondly, the balance chamber 1'4 communicates with the first connecting chamber 1'2, and when the first connecting chamber 1'2 is a high pressure end, the balance chamber 1'4 has a high pressure, which requires a high sealing performance and increases a risk of leakage.

Thirdly, it is difficult to process the through hole 3'11 on the small valve core 3'1.

In view of this, a technical problem to be solved presently by those skilled in the art is to provide an improved thermal expansion valve, which may improve the reliability of sealing between a valve body and an upper end portion of the valve core component, improve the sensitivity of the valve, and reduce the difficulty for processing the valve body and the valve core component, and also may eliminate pressure influence on the movement of the valve core component caused by a refrigerant in a first connecting chamber.

SUMMARY OF THE INVENTION

A technical problem to be solved by the present application is to provide a thermal expansion valve, which may improve the reliability of sealing between a valve body and an upper end portion of the valve core component, improve the sensitivity of the valve, and reduce the difficulty for processing the valve body and the valve core component, and also may eliminate pressure influence on the movement of the valve core component caused by a refrigerant in a first connecting chamber.

In order to solve the above technical problems, the present application provides a thermal expansion valve, including a valve body and a valve core component, wherein the valve body is provided with a first connecting chamber, a lower chamber in which a transmission component is arranged, and a first sealing component for separating the first connecting chamber from the lower chamber; a fifth pressure-bearing surface and a sixth pressure-bearing surface respectively subjected to pressures from a refrigerant in the first connecting chamber in opposite directions are arranged on a side wall of the valve core component; the first sealing component includes a first flexible sealing member which is arranged between the transmission component and an upper end portion of the valve core component and has a first edge portion connected to the valve body in a sealing manner; and a sum of an effective bearing area of a first pressure-bearing surface of the first flexible sealing member and a bearing area of the fifth pressure-bearing surface is substantially equal to a sum of an effective bearing area of a third pressure-bearing surface of the upper end portion of the valve core component and a bearing area of the sixth pressure-bearing surface.

Preferably, the effective bearing area of the first pressure-bearing surface is substantially equal to the effective bearing area of the third pressure-bearing surface, and the bearing area of the fifth pressure-bearing surface is substantially equal to the bearing area of the sixth pressure-bearing surface.

Preferably, the fifth pressure-bearing surface and the sixth pressure-bearing surface are both arranged in the first connecting chamber.

Preferably, the valve body is further provided with a second connecting chamber, a balance chamber in which an elastic component is arranged, and a second sealing component for separating the second connecting chamber from the balance chamber, and a seventh pressure-bearing surface and an eighth pressure-bearing surface respectively subjected to pressures in opposite directions are arranged on the side wall, in the second connecting chamber, of the valve core component; the second sealing component includes a second flexible sealing member which is arranged between the elastic component and an lower end portion of the valve core component and has a second edge portion connected to the valve body in a sealing manner; and a sum of an effective bearing area of a second pressure-bearing surface of the second flexible sealing member and a bearing area of the seventh pressure-bearing surface is substantially equal to a sum of an effective bearing area of a fourth pressure-bearing surface of the lower end portion of the valve core component and a bearing area of the eighth pressure-bearing surface.

Preferably, the effective bearing area of the second pressure-bearing surface is substantially equal to the effective bearing area of the fourth pressure-bearing surface, and the bearing area of the seventh pressure-bearing surface is substantially equal to the bearing area of the eighth pressure-bearing surface.

Preferably, the valve body is provide with a valve port, the valve core component is provided with an inclined sealing surface for sealing the valve port, and a sealing line or a sealing surface formed when the valve core component closes the valve port separates the inclined sealing surface into the sixth pressure-bearing surface in the first connecting chamber and the seventh pressure-bearing surface in the second connecting chamber.

Preferably, the first flexible sealing member is a first corrugated pipe; the first corrugated pipe includes a first corrugated sleeve portion stretchable in an axial direction, and a first straight section closing one end of the first corrugated sleeve portion; and the upper end portion of the valve core component extends into the first corrugated sleeve portion, and an upper end surface of the valve core component abuts against an inner side surface of the first straight section.

Preferably, the transmission component includes a transmission piece, and a transmission pin connected to the transmission piece, and the first straight section is arranged between the transmission pin and the upper end portion of the valve core component, and an outer side surface of the first straight section abuts against a bottom wall of the transmission pin.

Preferably, a mounting hole for mounting the first flexible sealing member is arranged at a top end portion of the valve body, and a nut is connected to the mounting hole via screw threads; the first corrugated sleeve portion and the transmission pin are arranged in an inner hole of the nut, and the nut presses the first edge portion against a bottom wall of the mounting hole; and the first edge portion is connected to the bottom wall of the mounting hole in a sealing manner.

Preferably, a first flange is arranged at a circumferential tail end of the first edge portion, a groove is arranged at a bottom end portion of a side wall of the mounting hole at a position corresponding to the first flange; and the first flange extends into the groove and is stuck at an outer side wall of the nut.

On the basis of the prior art, in the thermal expansion valve according to the present application, the first sealing component includes a first flexible sealing member which is arranged between the transmission component and the upper end portion of the valve core component and has the first edge portion connected to the valve body in a sealing manner. The first flexible sealing member stretches or contracts in an axial direction as the valve core component moves along the axial direction, and the first edge portion of the first flexible sealing member is connected to the valve body in a sealing manner, therefore the first flexible sealing member may separate the lower chamber from the first connecting chamber; and, the first edge portion and the valve body may be sealed by static sealing structures such as seal welding or sealing via a sealing member. Compared to the transmission seal structure in the prior art, the first edge portion and the valve body in the present application are sealed by a static sealing structure with a higher sealing reliability and a lower leakage probability, therefore the degree of superheat of the thermal expansion valve will not be increased, and the reliability and accuracy of the thermal expansion valve are significantly improved. Furthermore, in the present application, the sealing structure is arranged between the first edge portion and the valve body, instead of being arranged between the valve core component and the valve body, and thus the valve core component will not be influenced by the frictional resistance when moving along the axial direction, and the valve may have a higher sensitivity. Also, the first edge portion and the valve body in the present application are sealed by the static sealing structure instead of the transmission sealing structure in the prior art, thus the requirement for machining precision of the valve body and the valve core component is not high, thereby significantly reducing the processing difficulties.

Furthermore, a sum of the effective bearing area of the first pressure-bearing surface of the first flexible sealing member and the bearing area of the fifth pressure-bearing surface is substantially equal to a sum of the effective bearing area of the third pressure-bearing surface on the upper end portion of the valve core component and a bearing area of the sixth pressure-bearing surface, therefore the pressure influence on the valve core component caused by the refrigerant in the first connecting chamber can be eliminated.

In conclusion, the thermal expansion valve according to the present application can improve the reliability of sealing between the valve body and the upper end portion of the valve core component, improve the sensitivity of the valve, and reduce the difficulty for processing the valve body and the valve core component, and also may eliminate pressure influence on the movement of the valve core component caused by the refrigerant in the first connecting chamber.

BRIEF DESCRIPTION OF THE DRAWINGS

FIG. 4-1 is a schematic view showing an effective bearing area of a first corrugated pipe in FIGS. 2 and 3 under a first operating condition;

FIG. 4-2 is a schematic view showing an effective bearing area of the first corrugated pipe in FIGS. 2 and 3 under a second operating condition;

FIG. 7-1 is a top view of the thermal expansion valve in FIG. 7;

FIG. 7-2 is a bottom view of the thermal expansion valve in FIG. 7;

FIG. 7-3 is a sectional view of the thermal expansion valve taken along line A-A in FIG. 7;

FIG. 7-4 is a sectional view of the thermal expansion valve taken along line B-B in FIG. 7; and FIG. 7-5 is a sectional view of the thermal expansion valve taken along line C-C in FIG. 7.

Figure 1:
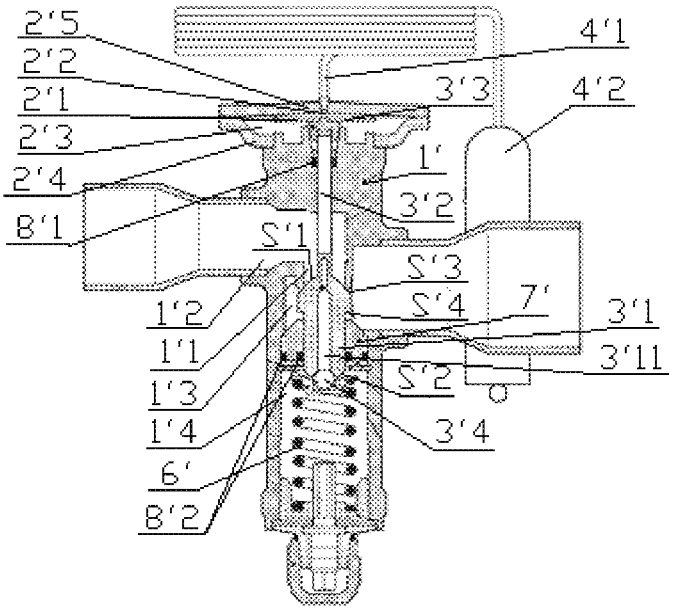
FIG. 1 is a schematic view showing the structure of a typical thermal expansion valve in the prior art.

The corresponding relationships between reference numerals and components in FIG. 1 are as follows.

| | | | |
|---|---|---|---|
| 1' | valve body, | 1'1 | valve port, |
| 1'2 | first connecting chamber, | 1'3 | second connecting chamber, |
| 1'4 | balance chamber, | | |
| 2'1 | diaphragm, | 2'2 | upper chamber, |
| 2'3 | lower chamber, | 2'4 | air box seat, |
| 2'5 | air box cap, | | |
| 3'1 | valve core, | 3'11 | through hole, |
| 3'2 | transmission rod, | 3'3 | transmission piece, |
| 3'4 | guide ball, | | |
| S'1 | first pressure-bearing surface, surface, | S'2 | second pressure-bearing |
| S'3 | third pressure-bearing surface, surface, | S'4 | fourth pressure-bearing |
| 4'1 | capillary tube, | 4'2 | thermo bulb, |
| 6' | spring, | 7' | guide ring, |
| 8'1 | first sealing member, and | 8'2 | second sealing member. |

Corresponding relationships between reference numerals and components in FIGS. 2 to 7-5 are as follows.

| | | | |
|---|---|---|---|
| 1 | valve body, | 11 | first connecting chamber, |
| 12 | second connecting chamber, | 13 | balance chamber, |
| 14 | mounting hole, | 141 | groove, |
| 15 | nut, | 16 | first inner stepped surface, |
| 17 | second inner stepped surface, | 18 | valve port; |
| 2 | valve core component, | 21 | transmission component, |
| 211 | transmission piece, | 212 | transmission pin, |
| 22 | elastic component, | 221 | spring seat, |
| 222 | spring, | 23 | sealing line; |
| 3 | air box, | 31 | air box seat, |
| 32 | air box cap, | 33 | diaphragm, |
| 34 | upper chamber, | 35 | lower chamber; |
| 4 | first corrugated pipe, | 41 | first edge portion, |
| 42 | first corrugated sleeve portion, | 43 | first straight section, |
| 44 | first flange, | 45 | first sealing member; |
| 5 | second corrugated pipe, | 51 | second edge portion, |
| 52 | second corrugated sleeve portion, | 53 | second straight section, |
| 54 | second flange, | 55 | second sealing member; |
| 6 | adjusting seat, | 61 | first spacer, |
| 62 | second spacer; | | |
| S1 | first pressure-bearing surface, | S2 | second pressure-bearing surface, |
| S3 | third pressure-bearing surface, | S4 | fourth pressure-bearing surface, |
| S5 | fifth pressure-bearing surface, | S6 | sixth pressure-bearing surface, |
| S7 | seventh pressure-bearing surface, and | S8 | eighth pressure-bearing surface. |

DETAILED DESCRIPTION OF THE INVENTION

An object of the present application is to provide a thermal expansion valve, which may improve the reliability of sealing between a valve body and an upper end portion of a valve core component, improve the sensitivity of the valve, reduce the manufacturing difficulty of the valve body and the valve core component, and eliminate the pressure influence on the movement of the valve core component caused by refrigerant in a first connecting chamber.

For those skilled in the art to better understand technical solutions of the present application, the present application is described in detail in conjunction with drawings and embodiments hereinafter.

Figure 2:
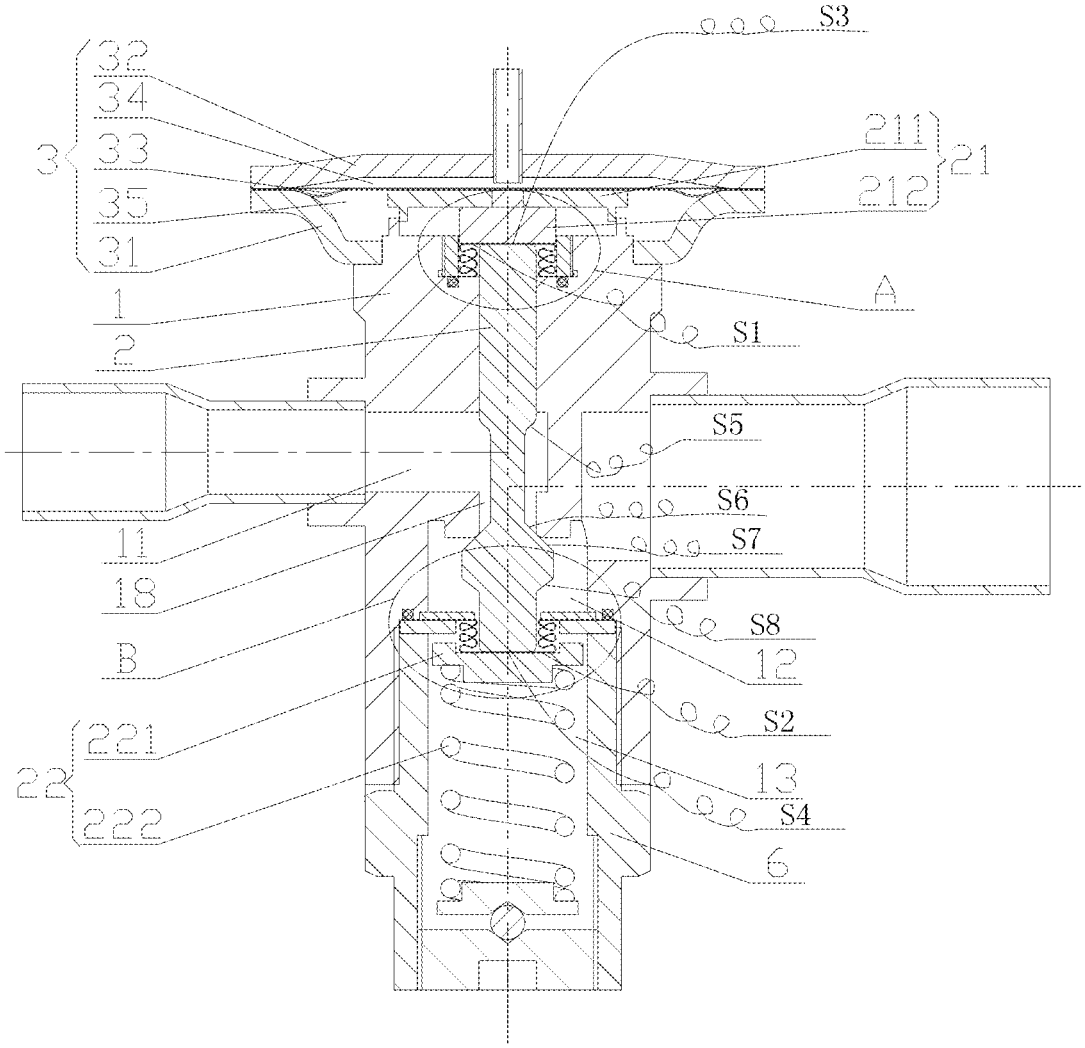
FIG. 2 is a schematic view showing the structure of a thermal expansion valve according to an embodiment of the present application.
Figure 3:
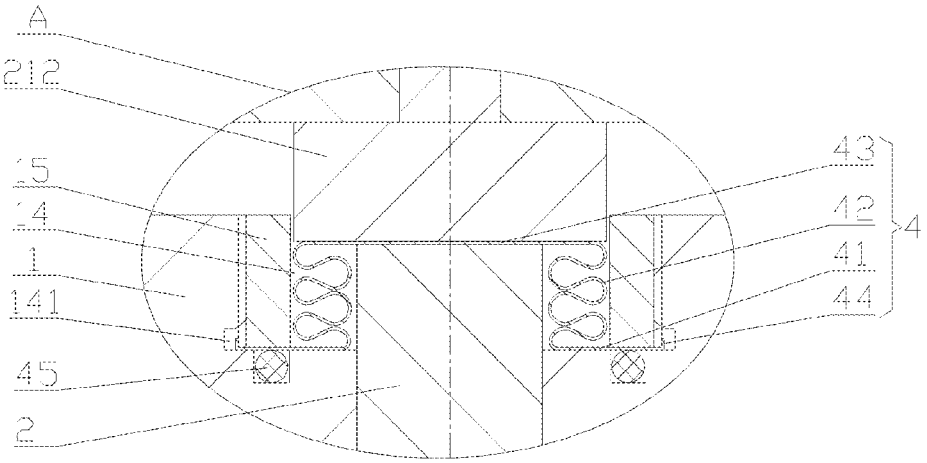
FIG. 3 is an enlarged view of part A of the thermal expansion valve in FIG. 2.
Figures 1, 4:
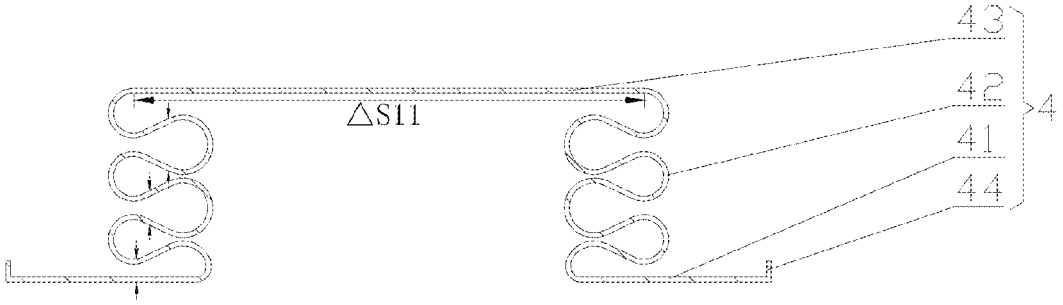
Figures 2, 4:
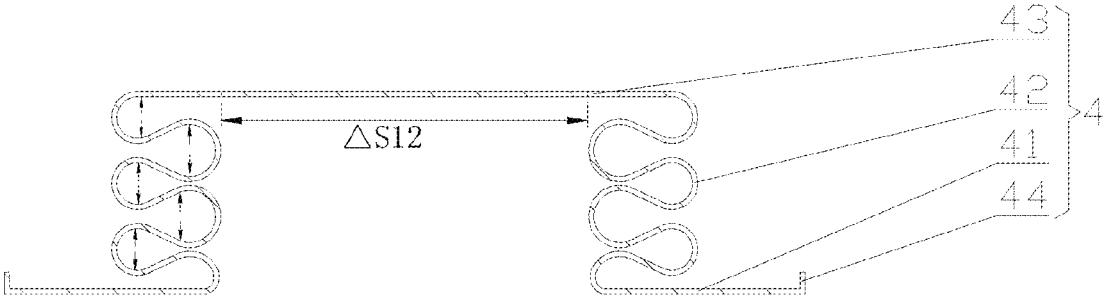

Referring to FIGS. 2, 3 and 4, FIG. 2 is a schematic view showing the structure of a thermal expansion valve according to an embodiment of the present application; FIG. 3 is an enlarged view of part A of the thermal expansion valve in FIG. 2; FIG. 4-1 is a schematic view showing an effective bearing area of a first corrugated pipe in FIGS. 2 and 3 under a first operating condition; and FIG. 4-2 is a schematic view showing an effective bearing area of the first corrugated pipe in FIGS. 2 and 3 under a second operating condition.

In an embodiment, as shown in FIG. 2, a thermal expansion valve according to the present application includes a valve body 1 and a valve core component 2 slidably cooperated with the valve body 1. An inner chamber of the valve body 1 is separated into a first connecting chamber 11 and a second connecting chamber 12 when the valve core component 2 seals a valve port 18. The valve body 1 is connected with an air box 3, and the air box 3 includes an air box seat 31, an air box cap 32, and a diaphragm 33 separating an inner chamber of the air box 3 into an upper chamber 34 and a lower chamber 35. A transmission component 21 is further arranged in the air box 3. The thermal expansion valve further includes a first sealing member isolating the first connecting chamber 11 from the lower chamber 35.

As shown in FIG. 2, on the basis of the prior art, the first sealing component includes a first flexible sealing member stretchable along with the movement of the valve core component 2. The first flexible sealing member is arranged between the transmission component 21 and an upper end portion of the valve core component 2, and has a first edge portion 41 connected to the valve body 1 in a sealing manner.

The first flexible sealing member stretches or contacts in an axial direction as the valve core component 2 moves along the axial direction, and the first edge portion 41 of the first flexible sealing member is connected to the valve body 1 in a sealing manner, therefore the first flexible sealing member may separate the lower chamber 35 from the first connecting chamber 11; and, the first edge portion 41 and the valve body 1 may be sealed by static sealing structures such as seal welding or sealing via a sealing member. Compared to the transmission seal structure in the prior art, the first edge portion 41 and the valve body 1 in the present application are sealed by a static sealing structure with a higher sealing reliability and a lower leakage probability, therefore the degree of superheat of the thermal expansion valve will not be increased, and the reliability and accuracy of the thermal expansion valve are significantly improved. Furthermore, in the present application, the sealing structure is arranged between the first edge portion 41 and the valve body 1, instead of being arranged between the valve core component 2 and the valve body 1, and thus the valve core component 2 will not be influenced by the frictional resistance when moving along the axial direction, and the valve may have a higher sensitivity. Also, the first edge portion 41 and the valve body 1 in the present application are sealed by the static sealing structure instead of the transmission sealing structure in the prior art, thus the requirement for machining precision of the valve body 1 and the valve core component 2 is not high, thereby significantly reducing the processing difficulties.

Furthermore, a sum of an effective bearing area of a first pressure-bearing surface S1 of the first flexible sealing member and a bearing area of a fifth pressure-bearing surface S5 is substantially equal to a sum of an effective bearing area of a third pressure-bearing surface S3 on the upper end portion of the valve core component 2 and a bearing area of a sixth pressure-bearing surface S6, therefore the pressure influence on the valve core component 2 caused by the refrigerant in the first connecting chamber 11 can be eliminated. It is to be noted that, the connotation of "substantially equal to or substantially equivalent" referred herein includes a case of having a deviation of plus or minus 5%, in addition to a case of being exactly equivalent.

The effective bearing area of the first pressure-bearing surface S1 of the first flexible sealing member is illustrated hereinafter by taking a first corrugated pipe 4 as an example.

A refrigerant pressure in the first connecting chamber is set as P. Since a chamber of the first corrugated pipe 4 at a side close to the valve core component 2 communicates with the first connecting chamber 11 via a gap between the valve core component 2 and the valve body 1, a refrigerant pressure in the first corrugated pipe 4 is also P. On this basis, the effective bearing area of the first pressure-bearing surface S1 is determined under two operating conditions. Under the first operating condition, as shown in FIG. 4-1, the first edge portion 41 is just in contact with a bottom wall of a mounting hole 14 rather than being connected to the bottom wall of a mounting hole 14, thus there is no acting force between them. Under this operating condition, each corrugation of the first corrugated pipe 4 is subjected to two opposite pressures P offsetting by one another, as shown by arrows in FIG. 4-1, and the effective bearing area of the first corrugated pipe is denoted by ΔS11 in FIG. 4. Under the second operating condition, as shown in FIG. 4-2, the first edge portion 41 is not only in contact with the bottom wall of the mounting hole 4 but also fixedly connected to the bottom wall of the mounting hole 4, thus there is an acting force between them. Under this operating condition, the first edge portion 41 is fixedly connected to the bottom wall of the mounting hole 4, and there is the acting force between them, thus the refrigerant pressure P applied on the first edge portion 41 may be offset by the acting force, which will not be analyzed herein. The force analysis of other corrugations of the first corrugated pipe is shown by arrows in FIG. 4-2, and the effective bearing area of the first pressure-bearing surface S1 is denoted by ΔS12 in FIG. 4-2. Therefore, the effective bearing area of the first pressure-bearing surface S1 of the first flexible sealing member may be determined by conventional technical analysis, and a required effective bearing area of the first pressure-bearing surface S1 may be obtained by conventional technical means in the prior art.

On the basis of the above technical solution, a further design can be made to simplify the structure. For example, the effective bearing area of the first pressure-bearing surface S1 is set to be substantially equal to the effective bearing area of the third pressure-bearing surface S3, and the bearing area of the fifth pressure-bearing surface S5 is set to be substantially equal to the bearing area of the sixth pressure-bearing surface S6.

Obviously, compared with ΔS11, ΔS12 is closer to an area of the upper end surface of the valve core component 2 (in the case of the upper end portion of the valve core component 2 having a consistent diameter, the effective bearing area of the third pressure-bearing surface S3 of the upper end portion of the valve core component 2 is equal to the area of the upper end surface), therefore, it is possible to make the effective bearing area of the first pressure-bearing surface S1 to be substantially equal to the effective bearing area of the third pressure-bearing surface S3 by conventional technical design.

Furthermore, a further improvement can also be made to the above technical solution. For example, as shown in FIG. 2, the valve body 1 is provided with a valve port 18, and the valve core component 2 is provided with an inclined sealing surface for sealing the valve port 18. A sealing line or sealing surface formed when the valve core component 2 closes the valve port 18 may separate the inclined sealing surface into the sixth pressure-bearing surface S6 in the first connecting chamber 11 and a seventh pressure-bearing surface S7 in the second connecting chamber 12.

On this basis, as shown in FIG. 2, a balance chamber 13 is also hermetically separated from the first connecting chamber 11, and a fifth pressure-bearing surface is further arranged on a side wall, within the first connecting chamber 11, of the valve core component 2, and a direction of a force applied on the fifth pressure-bearing surface is opposite to that on the sixth pressure-bearing surface S6. In the present application, since the fifth pressure-bearing surface S5 is arranged in the first connecting chamber 11 rather than in the balance chamber 13, it is not necessary to arrange a through hole on the valve core component 2 to communicate the first connecting chamber 11 with the balance chamber 13, and as a result a guide ball arranged at a lower end of the through hole may be omitted, thereby reducing the number of the parts of the valve core component 2, ensuring the dimensional tolerance in the axial direction of the valve core component 2, and improving the adjustment accuracy of the valve. Furthermore, since it is no necessary to arrange a through hole on the valve core component 2, the processing procedure of the valve core component 2 is simplified, and the processing difficulty thereof is reduced. Also, since the balance chamber 13 is hermetically separated from the first connecting chamber 11, a low pressure is maintained within the balance chamber 13 when the first connecting chamber 11 is a high pressure end, and since the balance chamber 13 is also hermetically separated from the second connecting chamber 12, there is almost no refrigerant within the balance chamber 13, thereby significantly reducing the sealing requirement of the balance chamber 13.

Figure 5:
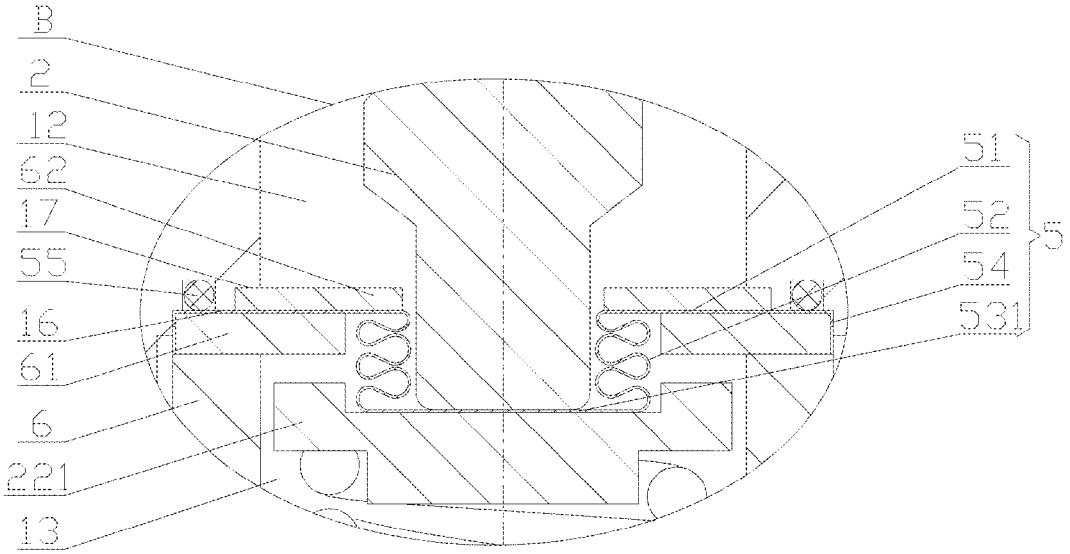
FIG. 5 is an enlarged view of part B of the thermal expansion valve in FIG. 2.
Figure 6:
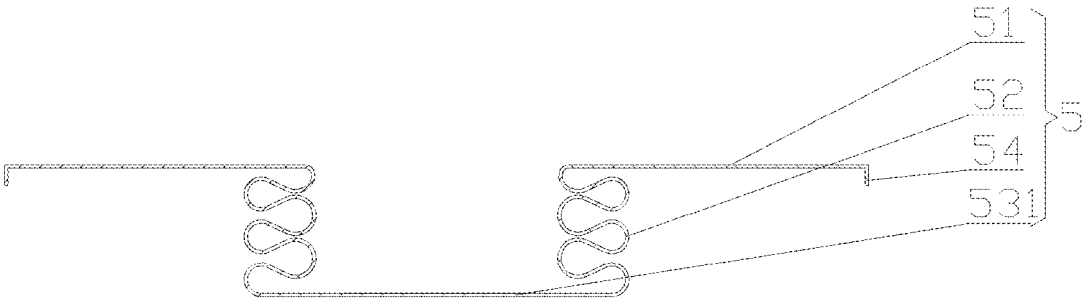
FIG. 6 is a schematic view showing the structure of a second corrugated pipe in FIGS. 2 and 5.

On the basis of the above technical solution, a further improvement can be made to further eliminate the pressure influence on the valve core component 2 caused by the refrigerant in the second connecting chamber 12. Referring to FIGS. 2, 5 and 6, FIG. 5 is an enlarged view of part B of the thermal expansion valve in FIG. 2; and FIG. 6 is a schematic view showing the structure of a second corrugated pipe in FIGS. 2 and 5.

As shown in FIG. 2, the valve body 1 includes the second connecting chamber 12, the balance chamber 13 having an elastic component 22 therein, and a second sealing component for separating the second connecting chamber 12 from the balance chamber 13. A seventh pressure-bearing surface S7 and an eighth pressure-bearing surface S8 subjected to pressures in opposite directions are arranged on a side wall, within the second connecting chamber 12, of the valve core component 2. On this basis, as shown in FIG. 2, the second sealing component includes a second flexible sealing member which is arranged between the elastic component 22 and a lower end portion of the valve core component 2 and has a second edge portion 51 connected to the valve body 1 in a sealing manner. The second flexible sealing member has substantially the same technical effects as the first flexible sealing member, which will not be described herein.

Furthermore, since a sum of an effective bearing area of the second pressure-bearing surface S2 of the second flexible sealing member and a bearing area of the seventh pressure-bearing surface S7 is substantially equal to a sum of an effective bearing area of a fourth pressure-bearing surface S4 of the lower end portion of the valve core component 2 and a bearing area of the eighth pressure-bearing surface S8, the pressure influence on the valve core component 2 caused by the refrigerant in the second connecting chamber 12 may be further eliminated on the basis of the pressure influence on the valve core component 2 caused by the refrigerant in the first connecting chamber 11 being eliminated. Therefore, a systematic pressure difference of the valve core component 2 is substantially equal to zero whether the refrigerant flows from the first connecting chamber 11 to the second connecting chamber 12 or from the second connecting chamber 12 to the first connecting chamber 11, thus a bidirectional balanced flow of the thermal expansion valve can be achieved.

It should be noted that, the interpretation of "the effective bearing area of the second pressure-bearing surface S2 of the second flexible sealing member" is the same as that of "the effective bearing area of the first pressure-bearing surface of the first flexible sealing member" described above, which will not be described herein.

Further, in order to simplify the structure to facilitate the calculation and process of the second pressure-bearing surface S2, the fourth pressure-bearing surface S4, the seventh pressure-bearing surface S7 and the eighth pressure-bearing surface S8, the effective bearing area of the second pressure-bearing surface S2 is set to be substantially equal to the effective bearing area of the fourth pressure-bearing surface S4, and the bearing area of the seventh pressure-bearing surface S7 is set to be substantially equal to the bearing area of the eighth pressure-bearing surface S8.

On the basis of any one of the above technical solutions, the specific structure of the first flexible sealing member can further be designed.

As shown in FIG. 4, the first flexible sealing member may be the first corrugated pipe 4. The first corrugated pipe 4 includes a first corrugated sleeve portion 42 stretchable in an axial direction, and a first straight section 43. The first straight section 43 closes a top end of the first corrugated sleeve portion 42, such that the first corrugated sleeve portion 42 has an opening facing downwards. On this basis, as shown in FIG. 3, the upper end portion of the valve core component 2 extends into the first corrugated sleeve portion 42, and an upper end surface of the valve core component 2 abuts against an inner side surface of the first straight section 43. In this structure, the first corrugated sleeve portion 42 is stretched or contracted in the axial direction with a higher regularity as the valve core component 2 moves along the axial direction, thereby realizing a higher working reliability. Further, the upper end surface of the valve core component 2 abuts against the inner side surface of the first straight section 43, which may facilitate the transmission of force.

In the above technical solutions, as shown in FIG. 2, the transmission component 21 includes a transmission piece 211 and a transmission pin 212 connected to the transmission piece 211, the first straight section 43 is arranged between the transmission pin 212 and the upper end portion of the valve core component 2, and an outer side surface of the first straight section 43 abuts against a bottom wall of the transmission pin 212. In order to transmit the force more effectively and reduce the abnormal deformation of the first straight section 43, as shown in FIG. 2, a contact area between the first straight section 43 and the transmission pin 212 should be as large as possible, such that the outer side surface of the first straight section 43 can completely or substantially completely cover the bottom wall of the transmission pin 212.

In the above technical solutions, a fixing structure of the first corrugated pipe 4 can also be designed specifically. For example, as shown in FIGS. 2 and 3, a mounting hole 14 is arranged at the top end portion of the valve body 1. The mounting hole 14 is used for arranging the first corrugated pipe 4, and a nut 15 is connected to the mounting hole 14 via screw threads. As shown in FIGS. 2 and 3, the nut 15 is mounted outside the first corrugated sleeve portion 42 and the transmission pin 212 via an inner hole thereof, and presses the first edge portion 41 against a bottom wall of the mounting hole 14. The first edge portion 41 is connected to the bottom wall of the mounting hole 14 in a sealing manner. Due to this fixing structure, the first corrugated pipe 4 can be fixedly mounted very conveniently, and since the nut 15 and the mounting hole 14 are detachably cooperated via screw threads, the nut 15 may be detached for replacing the first corrugated pipe 4 when the first corrugated pipe 4 is damaged. Further, the nut 15 presses the first edge portion 41 against the bottom wall of the mounting hole 14 through a certain torque, thereby further improving the sealing performance between the first edge portion 41 and the bottom wall of the mounting hole 14.

Further, in order to prevent vibration of the first corrugated pipe 4 in a radial direction, as shown in FIG. 4, a circumferential tail end of the first edge portion 41 may be further provided with a first flange 44, and as shown in FIG. 3, a bottom end portion of a side wall of the mounting hole 14 is provided with a groove 141 located at a position corresponding to the first flange 44. The first flange 44 extends into the groove 141 and is stuck at the outer side wall of the nut 15.

A seal structure between the first edge portion 41 and the bottom wall of the mounting hole 14 can also be designed. For example, the first edge portion 41 can be welded onto the bottom wall of the mounting hole 14 in a sealing manner, or a first sealing member 45 can be arranged between the first edge portion 41 and the bottom wall of the mounting hole 14.

Further, a specific structure of the second flexible sealing member can also be designed.

As shown in FIGS. 5 and 6, the second flexible sealing member is a second corrugated pipe 5. The second corrugated pipe 5 includes a second corrugated sleeve portion 52 stretchable in the axial direction, and a second straight section 53 closing a bottom end of the second corrugated sleeve portion 52. On this basis, as shown in FIG. 6, the second straight section 53 is sandwiched between a spring seat 221 and the lower end portion of the valve core component 2. In this structure, the second corrugated sleeve portion 52 is stretched or contracted in the axial direction with a higher regularity as the valve core component 2 moves in the axial direction, thereby realizing a higher working reliability.

As shown in FIG. 5, the lower end portion of the valve core component 2 extends into the second corrugated sleeve portion 52 via its top end, and the valve core component 2 has a planar lower end surface abutting against an inner side surface of the first straight section 53, thereby facilitating the transmission of force. Furthermore, an outer side surface of the second straight section 53 abuts against a top wall of the spring seat 221. As shown in FIG. 5, a groove is arranged at a top end of the spring seat 221, and the second straight section 53 is arranged in the groove. On this basis, in order to transmit the force more effectively and avoid the abnormal deformation of the second straight section 53, a contact area between the second straight section 53 and a bottom wall of the groove should be maximized, such that an outer side surface of the second straight section 53 may completely or substantially completely cover the bottom wall of the groove.

A fixing structure between the second edge portion 51 and the valve body 1 can also be designed specifically. For example, as shown in FIG. 5, a lower end of the valve body 1 is cooperated with an adjusting seat 6, and the valve body 1 is provided with an inner stepped surface. The adjusting seat 6 is arranged in an internally threaded hole at the lower end of the valve body 1 by threaded engagement, and on this basis, the second edge portion 51 is sandwiched between a top wall of the adjusting seat 6 and the inner stepped surface, and is connected to the inner stepped surface in a sealing manner. This structural design may achieve the fixation of the second edge portion 51 very conveniently, and has a simpler structure and a lower cost.

Of course, a further improvement may be made to the above fixing structure. For example, as shown in FIGS. 5 and 6, a first spacer 61 and a second spacer 62 are further arranged between the top wall of the adjusting seat 6 and the inner stepped surface in the axial direction. The inner stepped surface includes a first inner stepped surface 16 and a second inner stepped surface 17, the first spacer 61 is supported on the first inner stepped surface 16, and the second spacer 62 is supported on the second inner stepped surface 17. On this basis, the second edge portion 51 is further sandwiched between the first spacer 61 and the second spacer 62, and is connected to the first inner stepped surface 16 in a sealing manner. Due to this structural design, the position of the second edge portion 51 being sandwiched between two spacers may be fixed, which may avoid damage to the sealing connection structure between the second edge portion 51 and the valve body 1 caused by the second edge portion 51 squeezed by the refrigerant, thereby improving the stability and reliability of operation.

Further, as shown in FIG. 5, the second corrugated sleeve portion 52 is arranged in an inner hole of the first spacer 61, an inner end of the second spacer 62 extends, inwardly and radially, beyond an inner end of the first spacer 61 to abut against an inner end portion of the second edge portion 51. Due to this structural design, the second spacer 62 may substantially completely cover the second edge portion 51, and the second corrugated sleeve portion 52 may stretch or contract more regularly, which may avoid a large deformation of the second corrugated sleeve portion 52 when stretching or contracting, thereby improving the reliability of operation.

Furthermore, in order to prevent the vibration of the second corrugated pipe 5 in the radial direction, as shown in FIG. 5, a second flange 55 stuck at an outer side wall of the first spacer 61 is arranged at a circumferential tail end of the second edge portion 51.

Also, it is to be noted that, the first corrugated pipe 4 and the second corrugated pipe 5 may have the same rigidity and be arranged in opposite directions, thus elastic forces on the valve core component 2 from the first corrugated pipe 4 and from the second corrugated pipe 5 are equal but in opposite directions, which will not cause an additional force on the valve core component 2.

Figure 7:
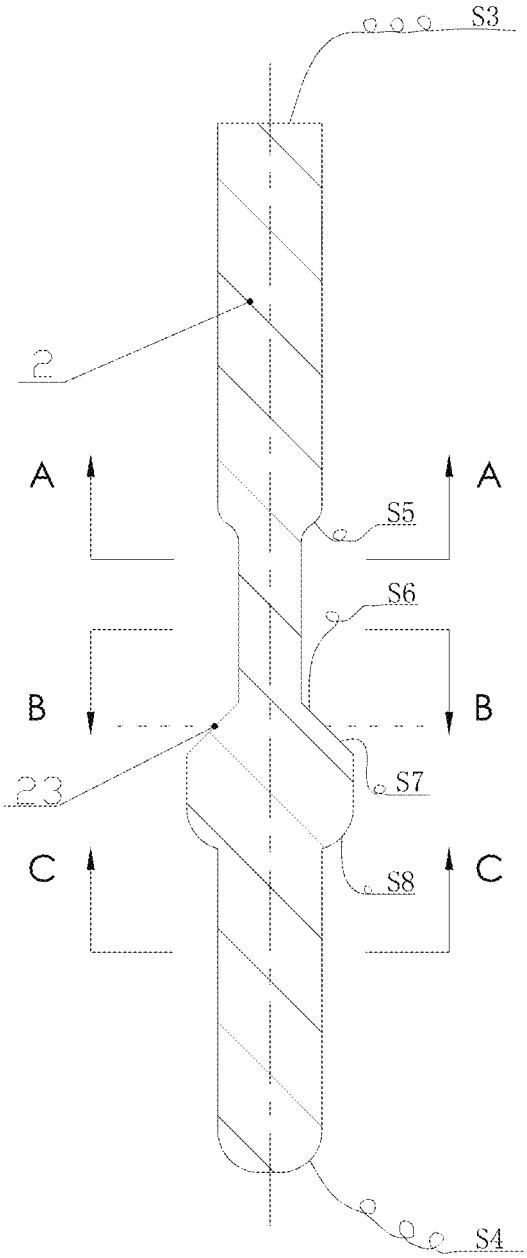
FIG. 7 is a schematic view showing the structure of a valve core component of the thermal expansion valve in FIG. 2.
Figures 1, 7:
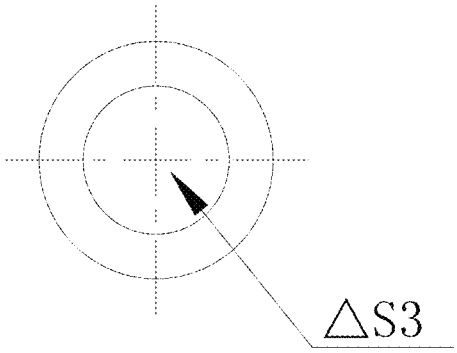
Figures 2, 7:
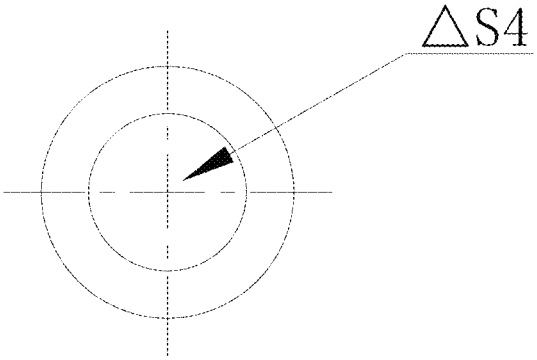
Figures 3, 7:
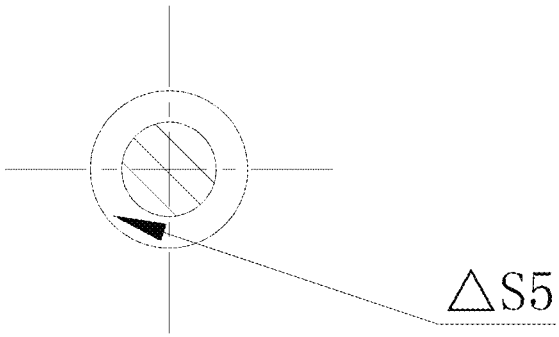
Figures 4, 7:
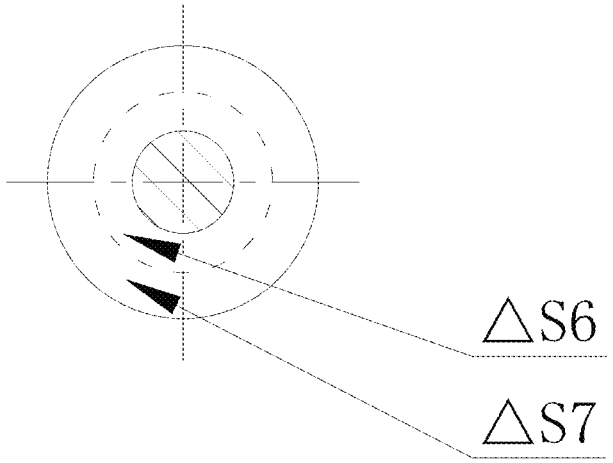
Figures 5, 7:
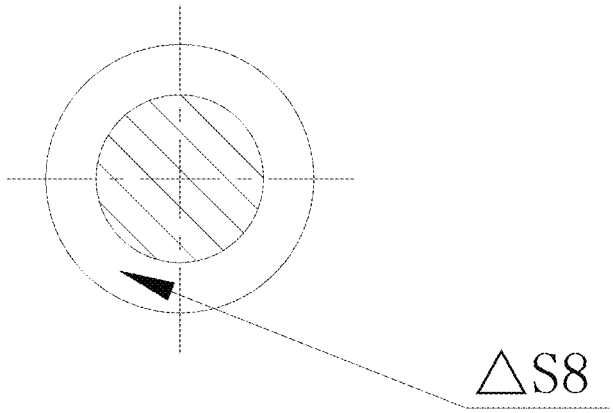

Description of the third pressure-bearing surface to the eighth pressure-surface is as follows. Referring to FIGS. 7, 7-1, 7-2, 7-3, 7-4 and 7-5, FIG. 7 is a schematic view showing the structure of the valve core component of the thermal expansion valve in FIG. 2; FIG. 7-1 is a top view of the thermal expansion valve in FIG. 7; FIG. 7-2 is a bottom view of the thermal expansion valve in FIG. 7; FIG. 7-3 is a sectional view of the thermal expansion valve in FIG. 7 taken along line A-A; FIG. 7-4 is a sectional view of the thermal expansion valve in FIG. 7 taken along line B-B; and FIG. 7-5 is a sectional view of the thermal expansion valve in FIG. 7 taken along line C-C.

As shown in FIG. 7-1, the bearing area of the third pressure-bearing surface S3 is denoted by ΔS3. As shown in FIG. 7-2, the bearing area of the fourth pressure-bearing surface S4 is denoted by ΔS4. As shown in FIG. 7-3, the bearing area of the fifth pressure-bearing surface S5 is denoted by ΔS5. As shown in FIG. 7-4, the bearing area of the sixth pressure-bearing surface S6 is denoted by ΔS6, and the bearing area of the seventh pressure-bearing surface S7 is denoted by ΔS7. As shown in FIG. 7-5, the bearing area of the eighth pressure-bearing surface S8 is denoted by ΔS8.

A thermal expansion valve according to the present application is described in detail hereinbefore. The principle and the embodiments of the present application are illustrated herein by specific examples. The above description of examples is only intended to help the understanding of the method and the spirit of the present application. It should be noted that, for the person skilled in the art, many modifications and improvements may be made to the present application without departing from the principle of the present application, and these modifications and improvements are also deemed to fall into the protection scope of the present application defined by the claims.

The invention claimed is:

1. A thermal expansion valve, comprising a valve body and a valve core component, wherein the valve body is provided with a first connecting chamber, a lower chamber in which a transmission component is arranged, and a first sealing component for separating the first connecting chamber from the lower chamber; a fifth pressure-bearing surface and a sixth pressure-bearing surface respectively subjected to pressures from a refrigerant in the first connecting chamber in opposite directions are arranged on a side wall of the valve core component; the first sealing component comprises a first flexible sealing member which is arranged between the transmission component and an upper end portion of the valve core component and has a first edge portion connected to the valve body in a sealing manner; and a sum of a bearing area of a first pressure-bearing surface, which is variable according to different operating conditions, of the first flexible sealing member and a bearing area of the fifth pressure-bearing surface is substantially equal to a sum of a bearing area of a third pressure-bearing surface of the upper end portion of the valve core component and a variable bearing area of the sixth pressure-bearing surface.

2. The thermal expansion valve according to claim 1, wherein the bearing area of the first pressure-bearing surface is substantially equal to the bearing area of the third pressure-bearing surface, and the bearing area of the fifth pressure-bearing surface is substantially equal to the bearing area of the sixth pressure-bearing surface.

3. The thermal expansion valve according to claim 1, wherein the fifth pressure-bearing surface and the sixth pressure-bearing surface are both arranged in the first connecting chamber.

4. The thermal expansion valve according to claim 1, wherein the valve body is further provided with a second connecting chamber, a balance chamber in which an elastic component is arranged, and a second sealing component for separating the second connecting chamber from the balance chamber, and a seventh pressure-bearing surface and an eighth pressure-bearing surface respectively subjected to pressures in opposite directions are arranged on the side wall, in the second connecting chamber, of the valve core component; the second sealing component comprises a second flexible sealing member which is arranged between the elastic component and an lower end portion of the valve core component and has a second edge portion connected to the valve body in a sealing manner; and a sum of a bearing area of a second pressure-bearing surface of the second flexible sealing member and a bearing area of the seventh pressure-bearing surface is substantially equal to a sum of a bearing area of a fourth pressure-bearing surface of the lower end portion of the valve core component and a bearing area of the eighth pressure-bearing surface.

5. The thermal expansion valve according to claim 4, wherein the bearing area of the second pressure-bearing surface is substantially equal to the bearing area of the fourth pressure-bearing surface, and the bearing area of the seventh pressure-bearing surface is substantially equal to the bearing area of the eighth pressure-bearing surface.

6. The thermal expansion valve according to claim 4, wherein the valve body is provide with a valve port, the valve core component is provided with an inclined sealing surface for sealing the valve port, and a sealing line or a sealing surface formed when the valve core component closes the valve port separates the inclined sealing surface into the sixth pressure-bearing surface in the first connecting chamber and the seventh pressure-bearing surface in the second connecting chamber.

7. The thermal expansion valve according to claim 1, wherein the first flexible sealing member is a first corrugated pipe; the first corrugated pipe comprises a first corrugated sleeve portion stretchable in an axial direction, and a first straight section closing one end of the first corrugated sleeve portion; and the upper end portion of the valve core component extends into the first corrugated sleeve portion, and an upper end surface of the valve core component abuts against an inner side surface of the first straight section.

8. The thermal expansion valve according to claim 7, wherein the transmission component comprises a transmission piece, and a transmission pin connected to the transmission piece, and the first straight section is arranged between the transmission pin and the upper end portion of the valve core component, and an outer side surface of the first straight section abuts against a bottom wall of the transmission pin.

9. The thermal expansion valve according to claim 8, wherein a mounting hole for mounting the first corrugated pipe is arranged at a top end portion of the valve body, and a nut is connected to the mounting hole via screw threads; the first corrugated sleeve portion and the transmission pin are arranged in an inner hole of the nut, and the nut presses the first edge portion against a bottom wall of the mounting hole; and the first edge portion is connected to the bottom wall of the mounting hole in a sealing manner.

10. The thermal expansion valve according to claim 9, wherein a first flange is arranged at a circumferential tail end of the first edge portion, a groove is arranged at a bottom end portion of a side wall of the mounting hole at a position corresponding to the first flange; and the first flange extends into the groove and is stuck at an outer side wall of the nut.

11. The thermal expansion valve according to claim 2, wherein the valve body is further provided with a second connecting chamber, a balance chamber in which an elastic component is arranged, and a second sealing component for separating the second connecting chamber from the balance chamber, and a seventh pressure-bearing surface and an eighth pressure-bearing surface respectively subjected to pressures in opposite directions are arranged on the side wall, in the second connecting chamber, of the valve core component; the second sealing component comprises a second flexible sealing member which is arranged between the elastic component and an lower end portion of the valve core component and has a second edge portion connected to the valve body in a sealing manner; and a sum of a bearing area of a second pressure-bearing surface of the second flexible sealing member and a bearing area of the seventh pressure-bearing surface is substantially equal to a sum of a bearing area of a fourth pressure-bearing surface of the lower end portion of the valve core component and a bearing area of the eighth pressure-bearing surface.

12. The thermal expansion valve according to claim 3, wherein the valve body is further provided with a second connecting chamber, a balance chamber in which an elastic component is arranged, and a second sealing component for separating the second connecting chamber from the balance chamber, and a seventh pressure-bearing surface and an eighth pressure-bearing surface respectively subjected to pressures in opposite directions are arranged on the side wall, in the second connecting chamber, of the valve core component; the second sealing component comprises a second flexible sealing member which is arranged between the elastic component and an lower end portion of the valve core component and has a second edge portion connected to the valve body in a sealing manner; and a sum of a bearing area of a second pressure-bearing surface of the second flexible sealing member and a bearing area of the seventh pressure-bearing surface is substantially equal to a sum of a bearing area of a fourth pressure-bearing surface of the lower end portion of the valve core component and a bearing area of the eighth pressure-bearing surface.

13. The thermal expansion valve according to claim 2, wherein the first flexible sealing member is a first corrugated pipe; the first corrugated pipe comprises a first corrugated sleeve portion stretchable in an axial direction, and a first straight section closing one end of the first corrugated sleeve portion; and the upper end portion of the valve core component extends into the first corrugated sleeve portion, and an upper end surface of the valve core component abuts against an inner side surface of the first straight section.

14. The thermal expansion valve according to claim 3, wherein the first flexible sealing member is a first corrugated pipe; the first corrugated pipe comprises a first corrugated sleeve portion stretchable in an axial direction, and a first straight section closing one end of the first corrugated sleeve portion; and the upper end portion of the valve core component extends into the first corrugated sleeve portion, and an upper end surface of the valve core component abuts against an inner side surface of the first straight section.

15. The thermal expansion valve according to claim 4, wherein the first flexible sealing member is a first corrugated pipe; the first corrugated pipe comprises a first corrugated sleeve portion stretchable in an axial direction, and a first straight section closing one end of the first corrugated sleeve portion; and the upper end portion of the valve core component extends into the first corrugated sleeve portion, and an upper end surface of the valve core component abuts against an inner side surface of the first straight section.

16. The thermal expansion valve according to claim 5, wherein the first flexible sealing member is a first corrugated pipe; the first corrugated pipe comprises a first corrugated sleeve portion stretchable in an axial direction, and a first straight section closing one end of the first corrugated sleeve portion; and the upper end portion of the valve core component extends into the first corrugated sleeve portion, and an upper end surface of the valve core component abuts against an inner side surface of the first straight section.

17. The thermal expansion valve according to claim 6, wherein the first flexible sealing member is a first corrugated pipe; the first corrugated pipe comprises a first corrugated sleeve portion stretchable in an axial direction, and a first straight section closing one end of the first corrugated sleeve portion; and the upper end portion of the valve core component extends into the first corrugated sleeve portion, and an upper end surface of the valve core component abuts against an inner side surface of the first straight section.

* * * * *